United States Patent [19]

Muckelrath

[11] 4,058,882

[45] Nov. 22, 1977

[54] METAL FENCE POST AND METHOD OF MAKING

[75] Inventor: Ernest R. Muckelrath, Tioga, N. Dak.

[73] Assignee: Tioga Air Heaters, Co., Tioga, N. Dak.

[21] Appl. No.: 622,426

[22] Filed: Oct. 15, 1975

[51] Int. Cl.[2] ..... B23Q 17/00

[52] U.S. Cl. ..... 29/407; 29/155 C; 29/445; 113/116 Y; 256/DIG. 5; 228/155; 228/164

[58] Field of Search ..... 29/150, 155 R, 155 C, 29/407, 445; 113/116 Y, 116 V; 256/36, 37, 52, 57, 48, DIG. 5; 72/324, 326, 332, 379; 52/146, 292; 228/155, 164

[56] References Cited

U.S. PATENT DOCUMENTS

| | | | |
|---|---|---|---|
| 565,966 | 8/1896 | Deck | 256/37 |
| 2,065,562 | 12/1936 | Brown | 256/52 |
| 2,233,719 | 3/1941 | Vanderveld | 29/155 R |
| 2,515,615 | 7/1950 | Tetzlaff | 256/52 |
| 3,502,303 | 3/1970 | Bishop | 256/52 |
| 3,908,328 | 9/1975 | Nelsson | 29/155 R X |

*Primary Examiner*—James R. Duzan

*Attorney, Agent, or Firm*—Clarence A. O'Brien; Harvey B. Jacobson

[57] ABSTRACT

A metal fence post having an irregular polygon shape which is strong and resists bending and twisting better than posts made of the same gauge metal but of other construction. The method of making the fence post and the manner in which fence wires are tied thereto in order to construct an extra strong fence are included.

1 Claim, 7 Drawing Figures

METAL FENCE POST AND METHOD OF MAKING

BACKGROUND OF THE INVENTION

This invention relates generally to metal fence posts, the method of making same, and the manner in which fence wires are attached thereto in order to construct an entire fence which is stronger than conventional fences.

DESCRIPTION OF THE PRIOR ART

The common problem of fence posts is that for a given gauge metal they do not have a great deal of post strength. Another problem has been with the manner of attaching fence wires to the fence posts. As generally applied in the field, most of the connectors used or the tie wires used do not add strength to the over-all fence. A further problem is that most fence posts and fence attaching means known in the prior art which do have relative strength and resistance against twisting and bending of the posts, while being driven into the ground and also while standing erect in a constructed fence, are much more expensive and much more complicated than the structure disclosed by this invention.

Known prior art patents which may be pertinent to this invention are listed as follows:

U.S. Pat. Nos: 423,201 - Mar. 11, 1890
456,022 - July 14, 1891
1,749,640 - Mar. 4, 1930
2,065,562 - Dec. 29, 1936
2,150,291 - Mar. 14, 1939
3,246,880 - Apr. 19, 1966
3,502,303 - Mar. 24, 1970.

None of these prior art patents have the unique and novel features as taught by the invention disclosed herein.

SUMMARY OF THE INVENTION

An object of the present invention is to provide a fence post which is stronger than normal for a given gauge metal.

Another object of this invention is to provide a fence post having a specially irregular polygon formed shape thereto for resisting bending and twisting when said post is being driven into the ground.

A further object of this invention is to provide a fence post which is easier to drive into the ground, and is better in resistance against being twisted or pulled out of place when in the ground.

A still further object of this invention is to provide a fence post having a better fence wire attach structure associated therewith, and one which will add strength to the over-all fence when said fence is properly erected according to the method taught herein.

Another further object of this invention is to provide the method of making the fence post to accomplish the objects set forth above.

One of the big features of the invention disclosed herein is in the special irregular polygon shape of the post itself which increases the strength of said post and the resistance to bending and twisting of said post, both while the post is being driven into the ground and also once the post is erected in a fence structure.

Another important feature is the manner of making this post and also the manner in which fence wires are attached to said post to increase the strength of the over-all fence by the secure and positive manner in which fence wires are securely fastened to a line of posts making up the fence.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
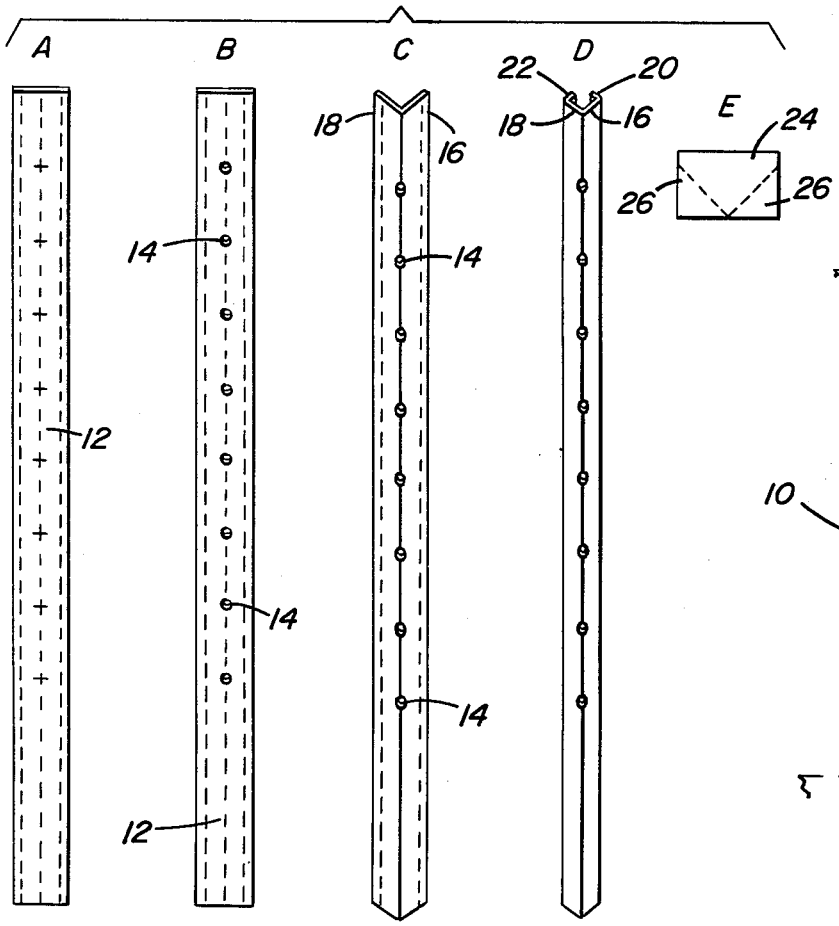
FIG. 1 is a perspective view of various stages of the method of making the fence post of this invention.
Figure 2:
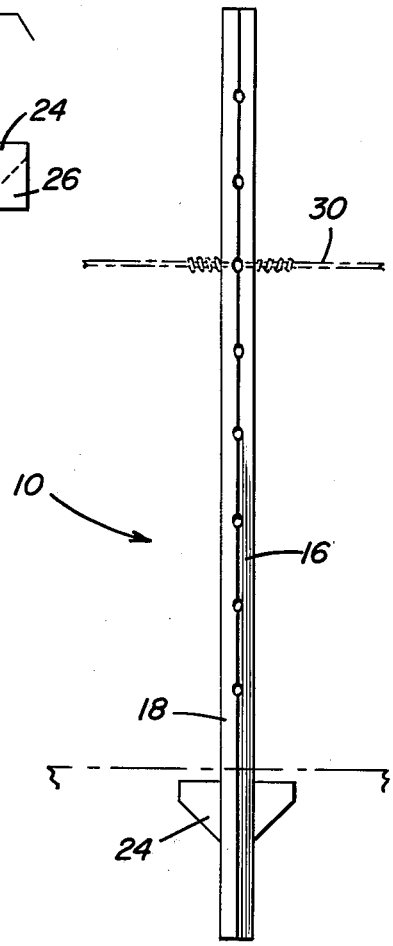
FIG. 2 is a perspective view of a completed fence post as driven in the ground and with a single fence wire attached thereto.
Figure 3:
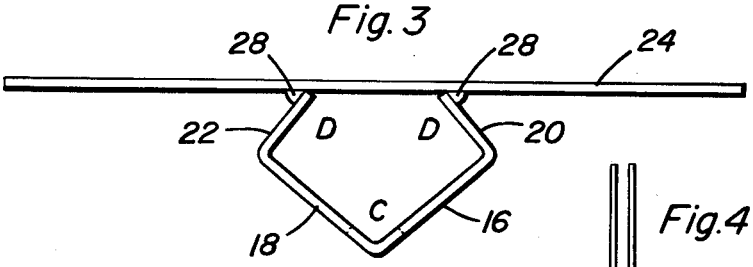
FIG. 3 is a cross-sectional view, greatly enlarged, looking down toward the bottom of said post from just above the ground holding plate attached thereto.

Referring to FIG. 2 of the drawings, reference numeral 10 indicates the new and novel fence post of this invention as erected and in a partially completed over-all fence. FIG. 1 shows the stages of construction and illustrates the method of making this fence post. Letter A shows the layout for the beginning of the fence post comprising a long rectangular piece of metal 12 of conventional gauge with appropriate indicia marked thereon to indicate the proper points for further working of said metal strip. Letter B indicates the second stage of making the fence post wherein the strip 12 has the holes 14 punched therein at the previously marked points on the strip. After the holes are punched, the first bending formation takes place. Letter C indicates this stage, wherein a bend is made along the center line of the rectangular metal strip, which can best be seen in FIG. 3 wherein letter C is placed at this point. Once this bend has been made, one side, the right side in FIG. 1C is referred to by reference numeral 16 and the left side by numeral 18. A final step in the method of making the main fence post body is in the final bending of the side edges of portions 16 and 18. This final bending step is shown in 1-D, and the enlarged view of FIG. 3, which forms the edge portions 20 and 22 in the final post. As can be seen in FIG. 3, the final fence post has an irregular polygon shape with one side missing or open, and it is this new shape which increases the strength and rigidity of the post to accomplish many of the desirable results mentioned previously. While the angles may vary, a central included angle of 100° and included angles of 110° in the sides 16 and 18 have operated satisfactorily. The last step in FIG. 1 is at E wherein the rectangular plate 24 has two corners thereof removed, the lower right and left corners of the figure, which are labelled 26, and are cut on a line approximately 45° from the bottom edge to the line of cut. As can be visualized, this produces a sharp pointed plate member which is then welded to the outer side edges 20 and 22 of the main fence post body as shown at 28 in FIG. 3. The fence post now, except for appropriate painting or other corrosion resistant treatment, is ready to be put into use.

When the post is being driven, the unique shape thereof will allow it to be driven without bending, breaking or twisting, and it is much easier to drive also. The lower slanted edges of the ground anchor 24 as well as the lower edges of the post itself may be sharpened, if desired, to make the force necessary for driving even less. Once the post is driven into the ground as shown in FIG. 2, the ground anchor 24 will prevent the post from being twisted or easily removed from the ground.

Figure 4:
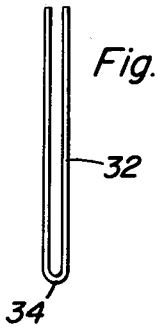
FIG. 4 is a perspective view, reduced in size, of a wire tie as used with this invention.
Figure 7:
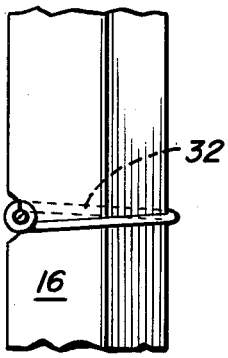
FIG. 7 is a side elevational view of the portion of fence of FIG. 5 looking from the right side of the post.
Figure 5:
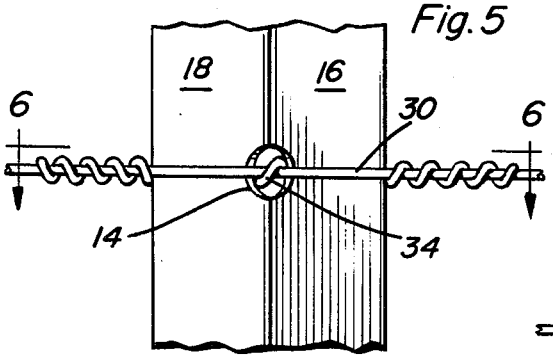
FIG. 5 is a front elevational view, greatly enlarged, taken at the portion of the post in FIG. 2 where the fence wire is attached.
Figure 6:
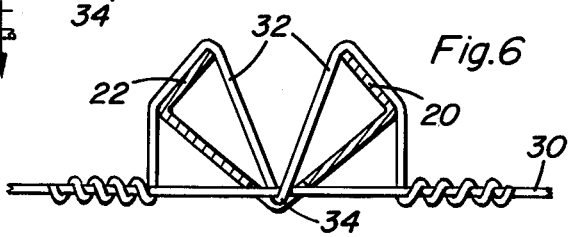
FIG. 6 is a cross-sectional view taken generally along line 6—6 of FIG. 5.

After a line of these posts are placed in line with appropriate spacing and driven into the ground, the fence wires themselves are attached thereto. The single wire 30 shown is merely an example, and normally a number of said wires would be attached to said post to form the over-all fence. The method and manner of attaching these wires also is part of this invention. FIG. 4 shows a wire tie which normally would be used and consist of a strong flexible wire 32 having a bend at the middle thereof 34, said wire normally being six or eight inches in length. The unique manner in which the fence wires 30 are attached can best be seen in FIGS. 5, 6 and 7. Looking at FIG. 5 we see the sides of the fence post 16 and 18 and the one hole or notch 14. The two open ends of the tie wire 32 are placed on either side of the fence wire 30 and fed through the hole 14 so that the closed loop portion 34 of the tie wire fits firmly against the fence wire 30, as best seen in FIG. 6. It is also important that the fence wire 30 fits tightly against the edges of the hole or notch 14. The two ends of the wire 32 are then bent around the outer side edge portions 20 and 22 of the fence post and returned to the fence wire 30 for securely wrapping thereabout. As can be visualized by looking at FIG. 6, once a fence wire is attached in this manner to a post, the fence wire and post are very strongly locked together so that the fence wire 30 cannot move either up or down or sideways and this feature increases the strength of the over-all fence. It being obvious that once a number of wires 30 are attached to a number of the holes in each post and a number of posts along the fence are all so secured a tremendous increase in strength is the result.

The new and unique fence post and method of making and using it as disclosed in this invention offers many advantages over conventional type posts and usual erection methods, yet is simple in construction and strong in final form.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A method of making a fence post comprising; the step of marking a long rectangular strip of metal at points therealong to be metal worked, then the step of punching holes at appropriate points along the center line of said strip, the further step of bending the strip along the center line to an approximately 100° included angle, next the step of bending inwardly each of the edges of the partially formed post at approximately a 110° included angle to form a post of generally polygon shape with one open side portion so that said post will resist twisting and bending when driven and erected, the additional step of providing a small rectangular strip of metal, cutting two corners of said rectangular member from the lengthwise side thereof to form a basic triangular anchoring plate, welding said anchoring plate to the open side portion of the polygon shaped post, and the further step of sharpening the lower slanted edges of the anchoring plate as well as the lower edges of the post itself to make the force necessary for driving same even less.

* * * * *